US005411205A

United States Patent [19]

Pfieffer

[11] Patent Number: 5,411,205

[45] Date of Patent: May 2, 1995

[54] CARTON WITH IMPROVED OPENING FEATURE

[75] Inventor: Gerald R. Pfieffer, Seattle, Wash.

[73] Assignee: Jefferson Smurfit Corporation, Clayton, Mo.

[21] Appl. No.: 305,566

[22] Filed: Sep. 14, 1994

[51] Int. Cl.[6] ..... B65D 5/54

[52] U.S. Cl. ..... 229/244; 229/207; 229/243; 229/902

[58] Field of Search ..... 229/207, 232, 243, 244, 229/902, 906

[56] References Cited

U.S. PATENT DOCUMENTS

| | | | |
|---|---|---|---|
| 1,988,582 | 1/1935 | Weiss | 229/232 |
| 2,828,060 | 3/1958 | Brown | 229/232 |
| 2,973,086 | 2/1961 | Thompson | 229/232 |
| 3,399,820 | 9/1968 | Foster et al. | 229/207 |
| 3,580,466 | 5/1971 | Thelen | 229/207 |
| 4,436,206 | 3/1984 | Kuchenbecker | 229/232 |
| 4,687,104 | 8/1987 | Ielmini | 229/232 |
| 4,746,019 | 5/1988 | Prater | 229/207 |
| 5,078,273 | 1/1992 | Kuchenbecker | 229/243 |
| 5,085,323 | 2/1992 | Kuchenbecker et al. | 229/232 |
| 5,100,004 | 3/1992 | Kuchenlecker | 229/244 |

*Primary Examiner*—Gary E. Elkins
*Attorney, Agent, or Firm*—Richard W. Carpenter

[57] ABSTRACT

A carton with an opening feature that includes a securing flap having a detachable center portion foldably joined to a detachable section of a top wall panel and being congruent with and adhesively secured to a detachable portion of the carton front wall panel, whereby the securing flap and carton front wall detachable portions can be pushed into the carton and then lifted to open the carton by separating the top wall center portion from the remainder of the carton top wall.

12 Claims, 2 Drawing Sheets

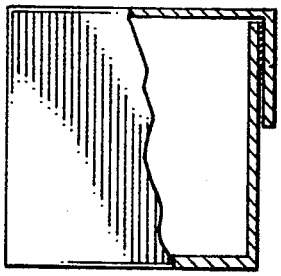
FIG. 1
(PRIOR ART)
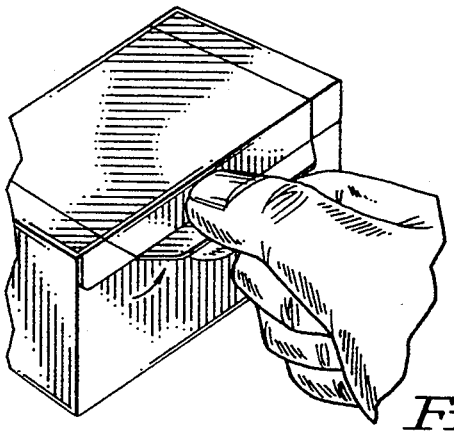
FIG. 2
(PRIOR ART)
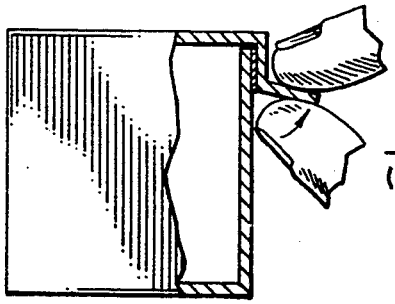
FIG. 3
(PRIOR ART)
FIG. 4
(PRIOR ART)
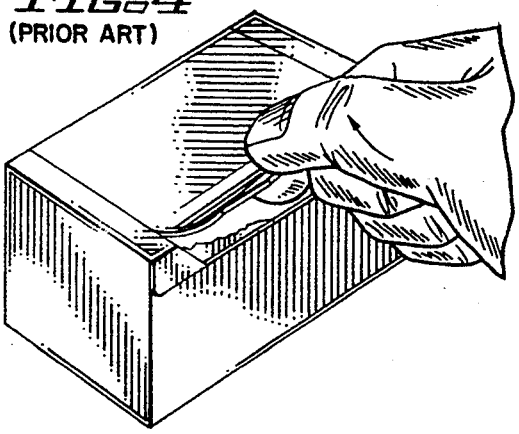
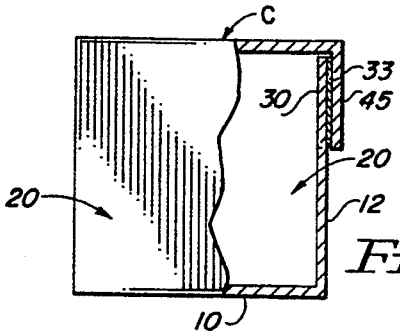
FIG. 5
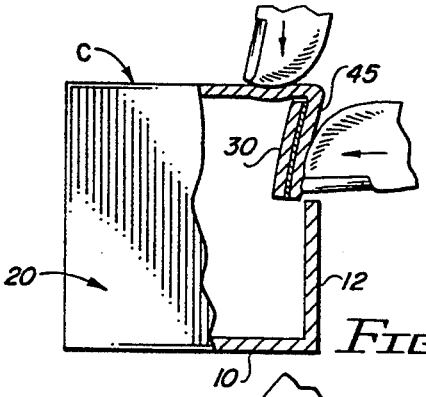
FIG. 6
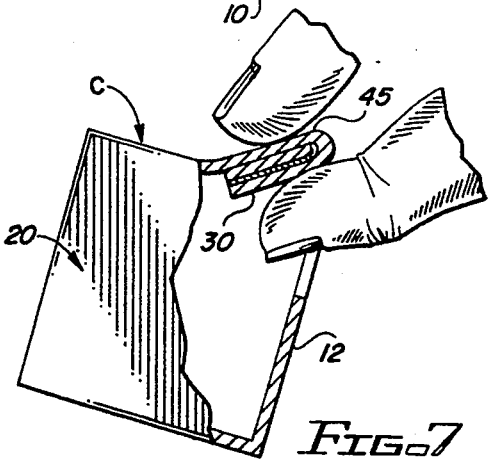
FIG. 7
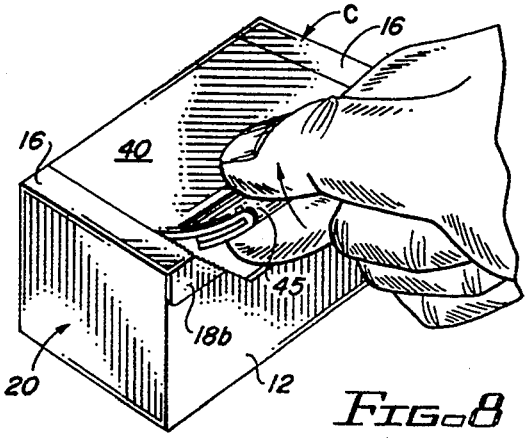
FIG. 8

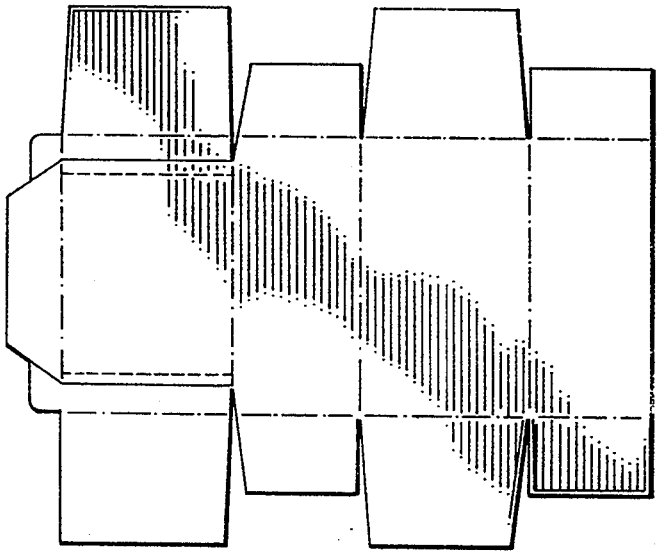
FIG. 9
(PRIOR ART)
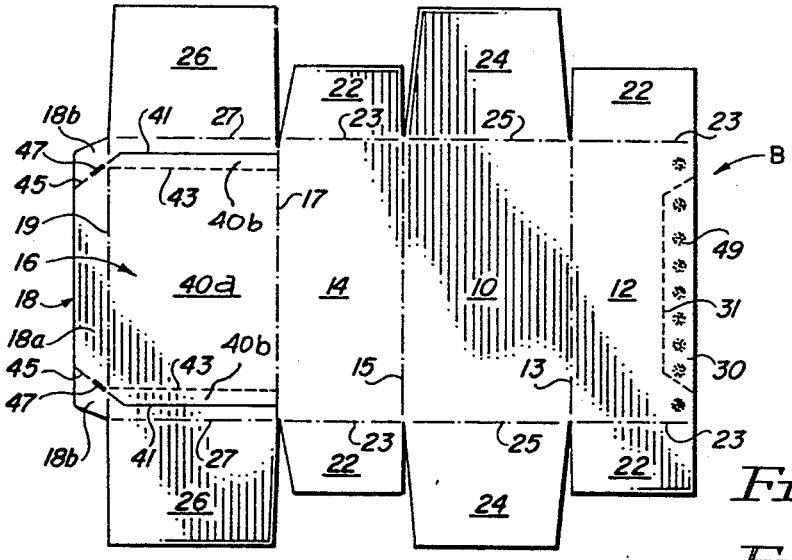
FIG. 10
FIG. 11
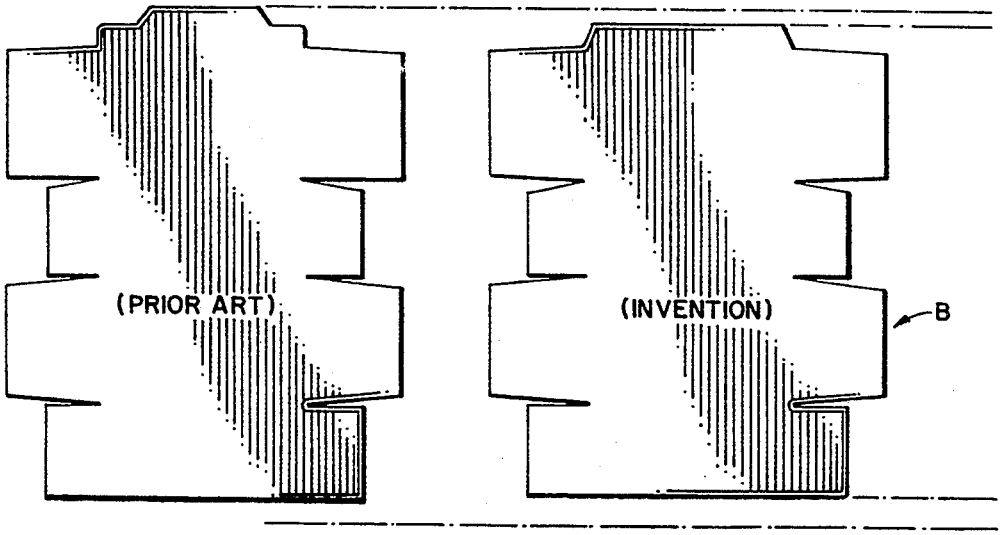

CARTON WITH IMPROVED OPENING FEATURE

BACKGROUND OF THE INVENTION

1. Field of the Invention

This invention relates to paperboard folding cartons, and more particularly to a carton with an improved opening feature that can be formed from a blank that requires less paperboard than blanks of conventional cartons of the same general type.

2. Description of the Background Art

A background art search directed to the subject matter of this invention conducted in the United States Patent and Trademark Office disclosed the following U.S. Pat. Nos.:

| | | | |
|---|---|---|---|
| 2,828,060 | 3,097,785 | 3,177,610 | 3,507,440 |
| 3,572,576 | 4,915,292 | 5,085,323 | |
| Belgium Patent | 657,238 | Japanese Patent | 404,279,447 |

None of the patents uncovered in the search discloses a carton including a front side wall panel, with a detachable strip portion having three sides defined by weakened lines of tear and a fourth side defined by a center-%area of the front side wall panel upper edge; a top wall panel, having a center section detachably connected to opposed end sections by weakened lines of tear; and a securing flap, foldably joined to the front edge of the top wall panel and having center and end sections detachably joined to each other by weakened lines of tear and aligned with said top wall panel center and end sections, respectively; wherein said securing flap center section is congruent with and adhesively secured to said front side wall panel detachable section.

SUMMARY OF THE INVENTION

It is a primary object of the invention to provide a one-piece, paperboard, folding carton with an improved opening feature.

Another object of the invention is the provision of a carton of the type described that can be made from a blank that requires less paperboard than the blanks from which conventional cartons of the type described are made.

Yet another object of the invention is to provide a carton of the type described wherein the upper part of the front side wall is pushed in and lifted to open the carton.

A more specific object of the invention is the provision of a carton including a front side wall panel, with a detachable strip portion having three sides defined by weakened lines of tear and a fourth side defined by a center area of the front side wall panel upper edge; a top wall panel, having a center section detachably connected to opposed end sections by weakened lines of tear; and a securing flap, foldably joined to the front edge of the top wall panel and having center and end sections detachably joined to each other by weakened lines of tear and aligned with said top wall panel center and end sections, respectively; wherein said securing flap center section is congruent with and adhesively secured to said front side wall panel detachable section and adjacent sides.

These and other objects of the invention will be apparent from an examination of the following description and drawings.

BRIEF DESCRIPTION OF THE DRAWINGS

FIG. 1 is a side elevational view, partially in vertical section, of a folding carton with a conventional opening arrangement found in the prior art;

FIG. 2 is an isometric view of the structure shown in FIG. 1, illustrating a first step in opening the carton;

FIG. 3 is a side elevational view of the structure shown in FIG. 2;

FIG. 4 is a view similar to that of FIG. 2, but showing the next step in opening the carton;

FIGS. 5–7 are side elevational views, partially in vertical section, of a carton embodying features of the present invention, illustrating steps in opening the carton of the present invention;

FIG. 8 is an isometric view of the structure shown in FIG. 7;

FIG. 9 is a plan view of the blank of paperboard used to form the carton structure shown in FIGS. 1–4;

FIG. 10 is a plan view Of the blank of paperboard used to form the carton structure of the present invention; and FIG. 11 is a fragmentary plan view illustrating a comparison in the shapes and sizes of the blanks shown in FIGS. 9 and 10.

It will be understood that, for purposes of clarity, certain elements may have been omitted from certain views where they are believed to be illustrated to better advantage in other views.

DESCRIPTION OF THE PREFERRED EMBODIMENT

Referring now to the drawings for a better understanding of the invention, it will be seen that the carton C, embodying features of the present invention and shown in FIGS. 5–8, may be formed from the unitary blank B of paperboard shown in FIG. 10.

In connection with the following description of the invention reference will be made to the comparable prior art carton structure shown in FIGS. 1–4, 10, and 11.

As best seen in FIGS. 1 and 10, carton C includes a generally rectangular bottom wall panel 10 having front and rear side wall panels 12 and 14 foldably joined to and upstanding from front and rear edges 13 and 15 thereof, respectively.

A top wall panel 16 is foldably joined at its rear edge, along fold line 17, to the upper edge of rear side wall panel 14 and extends forwardly therefrom.

Top wall panel 16 includes a center section **40*a*, which is detachably connected to the remaining end sections 40*b* of the top wall panel, by pairs of generally parallel partial cut lines 41 and 43** which extend only part way into the paperboard from the outer and inner surfaces thereof, respectively.

A securing flap 18 is foldably joined at its upper edge, along fold line 19, to the front edge of top wall panel 16. Securing flap 18 includes a center section **18*a* and a pair of end sections 18*b* which are aligned with top wall panel center and end sections 40*a* and 40*b***, respectively.

Center section 18 is separated from end sections **18*b* by a pair of diagonally extending cut lines 45, aligned with respective cut lines 41, and which preferably extend all the way through the paperboard, but which are interrupted by one or more nicks 47**, so that the center section can be readily detached from the end sections.

End walls 20 each include a pair of end wall inner panels 22, foldably joined on fold lines 23 to end edges of front and rear side wall panels 12 and 14; an end wall intermediate panel 24, foldably joined on fold line 25 to an end edge of bottom wall panel 10; and an end wall outer panel 26, foldably joined on fold line 27 to an end edge of top wall panel 16.

The heart of the invention lies in the opening feature of the carton. As best seen in FIGS. 5–8 and 10, the front side wall panel 12 includes a relatively narrow, elongated, detachable strip portion 30, which is defined on three sides by a weakened line of tear 31, and on the fourth or upper side by the upper edge of carton front side wall panel.

Detachable strip portion 30 is congruent with the securing flap center section 18a, and is secured thereto, when the carton is formed, by adhesive indicated generally at 49.

The carton is formed by the carton manufacturer and shipped to the packer as a collapsed tubular structure. After the carton has been erected and end loaded or,-filled, the end wall flaps can be secured to each other in overlapped relation.

It should be noted that the vertical dimension of the securing flap is the same as that of the front side wall panel detachable strip portion. This is different from the arrangement of conventional prior art cartons of this type, because the prior art cartons, as seen in FIGS. 1–4 and 9, require an additional tab that extends below the securing flap and is required to enable one to grasp and pull up the securing flap to open the carton. This is best seen in FIGS. 2–4.

Turning to FIGS. 5–8 of the drawings, it will be seen that the carton of the present invention does not require the extra flap, because the carton is adapted to be opened in a different manner. In the present invention the carton is opened by depressing the securing flap center section together with the front side wall panel detachable strip portion, to which it is attached, to separate them from the rest of the front side wall panel. This is shown in FIG. 6.

Then the securing flap center section and front side wall panel detachable strip portions are lifted to detach the top wall panel center section 40*a* from the end sections 40*b*, to open the carton.

FIG. 11 represents a comparison between the blank of the present invention and that of the prior art. It is apparent that the blank of the present invention requires less board than the blank of the prior art, and such savings of board represents a substantial savings of cost, when consideration of millions of square feet of paperboard are Concerned. In the case at hand, the savings of paperboard over the prior art is at least 3.3 per cent.

What is claimed is:

1. A carton having an improved opening feature, said carton being formed from a unitary blank of foldable paperboard and comprising:

(a) a generally rectangular bottom wall panel having opposed front and rear side wall panels foldably joined to and upstanding from front and rear side edges thereof, respectively;

(b) a top wall panel having a rear edge foldably joined to an upper edge of said rear side wall panel, and forming with said bottom and side wall panels a tubular structure open at the ends;

(c) said top wall panel having a center section and a pair of end sections detachably joined to opposed ends thereof by pairs of generally parallel, partial, cut lines in upper and lower surfaces thereof;

(d) end wall flaps foldably joined to end edges of said bottom, top, and side wall panels and secured to each other in overlapping relation, to form end walls for closing the open ends of said tubular structure;

(e) said front side wall panel including a relatively narrow, elongated, detachable strip portion having three edges defined by weakened lines of tear and a fourth edge defined by a central area of an upper edge of said front side wall panel;

(f) a relatively narrow, elongated, securing flap foldably joined at its upper edge to, and depending from, a front edge of said top wall panel;

(g) said securing flap having a vertical dimension substantially equal to the vertical dimension of said front wall panel detachable strip portion;

(h) said securing flap including a center section, aligned with said top wall panel center section, and a pair of end sections, detachably secured to opposed ends of said center section, by a pair of interrupted cut lines extending therethrough aligned with certain of said top wall panel cut lines, said securing flap center and end sections being aligned with respective top wall panel end sections;

(i) said securing flap center section being adhesively secured to an outer surface of said front side wall panel detachable strip portion, and said securing flap end sections being adhesively secured to outer surfaces of adjacent portions of said front side wall panel;

(j) said securing flap center section being adapted to be depressed with said front side wall detachable strip portion, to detach said securing flap center section from said securing flap end sections and also detach said front side wall panel detachable strip portion from the remainder of said front side wall panel, whereby said securing flap center section and said front wall panel detachable strip portion can thereafter be lifted, to detach said top wall panel center section from said top wall panel end sections to open the carton.

2. A carton according to claim 1, wherein said securing flap has the same horizontal dimension as that of said front side wall panel and the same vertical dimension as that of said front side wall panel detachable strip portion.

3. A carton according to claim 1, wherein said securing flap center section is congruent to said front side wall panel detachable strip portion.

4. A carton having an improved opening feature, said carton being formed from a unitary blank of foldable paperboard and comprising:

(a) a generally rectangular bottom wall panel having opposed front and rear side wall panels foldably joined to and upstanding from front and rear side edges thereof, respectively;

(b) a top wall panel having a rear edge foldably joined to an upper edge of said rear side wall panel, and forming with said bottom and side Wall panels a tubular structure open at the ends;

(c) said top wall panel having a center section and a pair of end sections detachably joined to opposed ends thereof;

(d) end wall flaps foldably joined to end edges of certain of said bottom, top, and side wall panels and secured to each other in overlapping relation, to form end walls for closing the open ends of said tubular structure;

(e) said front side wall panel including a relatively narrow, elongated, detachable strip portion having three edges defined by weakened lines of tear and a fourth edge defined by a central area of an upper edge of said front side wall panel;

(f) a relatively narrow, elongated, securing flap foldably joined at its upper edge to, and depending from, a front edge of said top wall panel;

(g) said securing flap having a vertical dimension substantially equal to the vertical dimension of said front wall panel detachable strip portion;

(h) said securing flap including a center section, aligned with said top wall panel center section, and a pair of end sections, detachably secured to opposed ends of said center section and aligned with respective top wall panel end sections;

(i) said securing flap center section being adhesively secured to an outer surface of said front side wall panel detachable strip portion, and said securing flap end sections being adhesively secured to outer surfaces of adjacent portions of said front side wall panel;

(j) said securing flap center section being adapted to be depressed with said front side wall detachable strip portion, to detach said securing flap center section from said securing flap end sections and also detach said front side wall panel detachable strip portion from the remainder of said front side wall panel, whereby said securing flap center section and said front wall panel detachable strip portion can thereafter be lifted, to detach said top wall panel center section from said top wall panel end sections to open the carton.

5. A carton according to claim 4, wherein said securing flap has the same horizontal dimension as that of said front side wall panel and the same vertical dimension as that of said front side wall panel detachable strip portion.

6. A carton according to claim 4, wherein said securing flap center section is congruent to said front side wall panel detachable strip portion.

7. A carton according to claim 4, wherein said top wall panel center section is detachably connected to said top wall panel end sections by pairs of parallel, partial, cut lines in upper and lower surfaces thereof.

8. A carton according to claim 2, wherein said securing flap center section is detachably secured to opposed ends of said center section, by a pair of interrupted cut lines extending therethrough.

9. A unitary blank of foldable paperboard cut and scored to form a carton having an improved opening feature, said blank comprising:

(a) a generally rectangular bottom wall panel having opposed front and rear side wall panels foldably joined to front and rear side edges thereof, respectively;

(b) a top wall panel having an inboard edge foldably joined to an outboard edge of said rear side wall panel;

(c) said top wall panel having a center section and a pair of end sections detachably joined to opposed ends thereof;

(d) end wall flaps foldably joined to end edges of said bottom, top, and side wall panels;

(e) said front side wall panel including a relatively narrow, elongated, detachable strip portion having three edges defined by weakened lines of tear and a fourth edge defined by a central area of a free outboard edge of said front side wall panel;

(f) a relatively narrow, elongated, securing flap foldably joined at its inboard edge to an outboard edge of said top wall panel;

(g) said securing flap including a center section, aligned with said top wall panel center section, and a pair of end sections, detachably secured to opposed ends of said center section and aligned with respective top wall panel end sections;

(h) said securing flap having the same length as said front side wall panel and having the same width as said front wall panel detachable strip portion.

10. A blank according to claim 9, wherein said securing flap center section is congruent to said front side wall panel detachable strip portion.

11. A blank according to claim 9, wherein said top wall panel center section is detachably connected to said top wall panel end sections by pairs of parallel, partial, cut lines in upper and lower surfaces thereof.

12. A blank according to claim 9, wherein said securing flap center section is detachably secured to opposed ends of said center section, by a pair of interrupted cut lines extending therethrough.

* * * * *